US009305469B2

(12) United States Patent
Milne

(10) Patent No.: US 9,305,469 B2
(45) Date of Patent: Apr. 5, 2016

(54) METHOD OF MOUNTING SUBSEA ANTIFOULING SIGNS

(71) Applicant: THE CHAMPION PARTNERSHIP, a Scottish Partnership, Aberdeen (GB)

(72) Inventor: John Alastair Milne, Aberdeen (GB)

(73) Assignee: THE CHAMPION PARTNERSHIP, Aberdeen (GB)

( * ) Notice: Subject to any disclaimer, the term of this patent is extended or adjusted under 35 U.S.C. 154(b) by 0 days.

(21) Appl. No.: 13/621,461

(22) Filed: Sep. 17, 2012

(65) Prior Publication Data

US 2013/0067783 A1 Mar. 21, 2013

(30) Foreign Application Priority Data

Sep. 15, 2011 (GB) ..... 1116011.6

(51) Int. Cl.

| | |
|---|---|
| ***G09F 7/12*** | (2006.01) |
| ***G09F 7/18*** | (2006.01) |
| ***G09F 3/10*** | (2006.01) |
| ***G09F 19/22*** | (2006.01) |
| ***G09F 7/00*** | (2006.01) |

(52) U.S. Cl.

CPC .. *G09F 7/18* (2013.01); *G09F 3/10* (2013.01); *G09F 7/002* (2013.01); *G09F 19/22* (2013.01); *G09F 2007/1804* (2013.01)

(58) Field of Classification Search

CPC ..... G09F 2007/1804
USPC ..... 40/606.1, 718
See application file for complete search history.

(56) References Cited

U.S. PATENT DOCUMENTS

| | | | | |
|---|---|---|---|---|
| 5,613,942 | A * | 3/1997 | Lucast | C09J 7/045 602/44 |
| 5,989,369 | A * | 11/1999 | Light | 156/71 |
| 6,296,730 | B1 * | 10/2001 | Williams | B29C 73/10 156/331.6 |
| 6,491,781 | B1 * | 12/2002 | Kreckel et al. | 156/277 |
| 2006/0168720 | A1 * | 8/2006 | Dellarocca | 4/559 |
| 2006/0201041 | A1 * | 9/2006 | Ehrmann et al. | 40/675 |
| 2008/0254698 | A1 * | 10/2008 | Yao et al. | 442/181 |
| 2011/0146126 | A1 * | 6/2011 | Phillips | 40/738 |

FOREIGN PATENT DOCUMENTS

| | | |
|---|---|---|
| EP | 0171110 | 12/1988 |
| GB | 1506921 | 4/1978 |
| GB | 2434022 | 7/2007 |
| GB | 2473526 | 3/2011 |
| WO | 2005/042220 | 5/2005 |
| WO | 2007/059264 | 5/2007 |
| WO | 2010/086579 | 8/2010 |

* cited by examiner

*Primary Examiner* — Kristina Junge
(74) *Attorney, Agent, or Firm* — Nixon & Vanderhye P.C.

(57) ABSTRACT

A subsea antifouling sign and a method for mounting such a sign on a structure to be located subsea. The sign comprises a body of an antifouling material, and a first surface of the body has indicia or markings thereon. An adhesive layer or coating is provided on a second opposing surface, and a protective lining is located on the adhesive layer or coating. The method comprises removing the protective lining from the adhesive layer or coating; and attaching the subsea antifouling sign to the structure by adhering the adhesive layer or coating to a surface of the structure.

15 Claims, 7 Drawing Sheets

METHOD OF MOUNTING SUBSEA ANTIFOULING SIGNS

The present invention relates to a subsea antifouling sign, and to a method of mounting a subsea antifouling sign on a structure to be located subsea. Aspects of the invention relate to methods of forming a subsea antifouling sign and subsea structures having such signs mounted thereon.

BACKGROUND TO THE INVENTION

Signs incorporating visual characters such as numerals, letters, words, phrases, sentences or other indicia are utilised in offshore aquatic environments such as subsea locations, for marking or providing information about an object located below the surface or on the seabed. Such signs have particular utility in the oil and gas exploration and production industry. Aquatic growth, such as barnacles, algae and other aquatic vegetation is a problem in these environments, and can cause fouling of the signs so that they become illegible.

In an effort to overcome these problems, polymeric antifouling silicone-based compositions were developed in the 1980s which resist such aquatic growth, as disclosed for example in European Patent Publication No. 0171110. Signs manufactured from or incorporating these materials comprise a semi-compatible lubricant, which has a tendency to leach out from the surface of the sign in use, thereby preventing aquatic growth and fouling of the sign.

International Patent Publication No. WO 2005/042220 discloses a moulding method and apparatus used in the manufacture of anti-fouling signs. In general terms, the signs are manufactured by constructing a mould; forming a character template on a surface of the mould; pouring a silicone material into the mould to form visual characters defined by the template; partially curing the characters; removing the template; coupling a backing sheet to the mould; inclining the mould from the horizontal; pouring a relief, substrate silicone material (of a different colour) into the mould through a small aperture; curing the sign; and then releasing the completed sign from the mould. Whilst signs manufactured according to this method function well in terms of resisting aquatic growth, there are various disadvantages or problems associated with the moulding method and the resultant signs.

In particular, the nature of the materials used to manufacture the signs creates difficulties in bonding the signs to a subsea object. To address this, the signs incorporate a backing layer with an irregular surface. A preferred sheet is of a type including loops, such as those provided on hook-and-loop fastener sheets, sold under the VELCRO® Trade Mark. During manufacture of the sign, the silicone material forms a mechanical connection with the loops on the backing layer. The completed sign may then be attached to an object to be located subsea using a suitable adhesive which bonds to the backing layer. However, a thin layer of a plastic material is provided on the backing sheet on the surface opposite that bearing the loops, to prevent uncured silicone from seeping through the VELCRO® sheet during manufacture.

This thin layer of plastics material can be easily detached from the backing sheet, reducing mechanical strength of the sign, in use. Furthermore, the backing layer adds to the manufacturing time and cost of the sign, and reduces flexibility.

Employing an adhesive to mount polymeric antifouling markers can provide satisfactory results if carried out correctly. However, the success of the bond depends upon the skill and knowledge of the individual carrying out the process. If the methods are not carried out correctly then a weaker than expected bond forms between the marker and the subsea structure which can result in the marker becoming detached from the subsea structure such that the associated information contained on the marker is lost. Adhesives for subsea use are often formed by mixing two components, for example a two-part polyurethane-based adhesives. The adhesive bonding system commercially available from Champion Environmental Techologies under the trade mark AQUAHESIVE™ is an example of such a system, and has an accepted operational lifetime subsea of around 50 years.

With two-part adhesive systems incorrect mixing can compromise the effectiveness of the adhesive. Even if correctly mixed, the adhesive has a limited useful period during which it can be applied, which may not be more than thirty or forty minutes. This means that individuals may attempt to use the subsea adhesives at the end of their useful lifetimes, which results in poor adhesion of the subsea markers. The adhesive needs to be carefully applied, with incorrect application resulting in a deficient bond. Furthermore, if the adhesion process is carried out on land then a number of factors have been found to weaken the bond, e.g. heat and humidity.

These adhesion issues are exacerbated due to the harsh conditions in which the markers operate. Accessing the subsea structures, e.g. for intervention or maintenance purposes, typically requires the use of divers and/or remotely operated vehicles (ROV). It is common for the diver or the ROV to come into contact with the marker when trying to read the information carried by the marker. This can act to damage the marker or completely dislodge the marker if not properly bonded with the subsea structure. In practice, it is found that if the edge of a polymeric antifouling marker is damaged then this acts as a point of weakness within the marker which can result in further tearing or disintegration of the marker.

The subsea structures and markers are also required to be cleaned during their operating lifetimes. Typically this is achieved by the employment of high pressure (5000 psi) water jet cleaning systems. A marker can be damaged by such a process or, if incorrectly bonded, the marker can be dislodged as a result of the jet washing process.

An additional problem with many of the prior art mounting arrangements is that corrosion of the subsea structure may be caused or accelerated by a volume of static or stagnant salt water between the subsea structure and the subsea antifouling sign.

One approach to mounting polymeric antifouling signs is to manufacture them in the form of a tag wherein apertures are formed in the backing substrate of the sign (FIG. 1). This design allows the sign 10 to be attached to a subsea structure 11 by the employment of a steel wire 12, or other similar attachment means, which is threaded through the apertures 13 without the use of adhesives. This method simplifies the attachment process so that less skilled individuals can attach the signs prior to deployment subsea. However, signs attached in this manner are found to move about the mounting such that when required to be detected at a later date, the information can be hidden from a diver or ROV attempting to locate the sign.

Mountings of the type in FIG. 1 have been configured to provide stand-off between the sign and the structure to which it is mounted. This reduces the effects of stagnant water behind the sign, but does not eliminate the problem and resulting corrosion remains a concern.

Another method of using polymeric antifouling signs is described in UK patent publication number GB 2473526. The method provides a backing member and a fixing frame which attaches to the backing member to secure the perimeter of the antifouling marker between the fixing frame and the backing member. Whilst this method is convenient to protect the antifouling marker and the identification tag from physical damage, it has other drawbacks such as involving multiple fabrication and assembly steps, the need of skilled labour to weld the fixing frame to the backing member, and the additional cost of the mount. In addition, the system of GB 2473526 uses bolts. There is a perception that the bolts may become loose over time and potentially damage paints or coatings on the structure. There may also be concerns about the long term effects caused by the inside of bolt holes not being protected by corrosion resistant coatings or paint schemes.

GB 2434022 describes an alternative mounting method for subsea antifouling signs wherein a silicone-based adhesive compatible with the material of the subsea antifouling sign is used.

It is an object of an aspect of the present invention to obviate or at least mitigate the foregoing disadvantages of previous methods of mounting a subsea antifouling sign to a subsea structure. Another object of the invention is to provide an easy, reliable and fast method of mounting a subsea antifouling sign to a subsea structure. A further object of the invention is to provide a subsea antifouling sign mounted on a subsea structure which is securely attached to the subsea structure for extended periods of time in the harsh conditions encountered in subsea environments. Further aims of the invention will become apparent from the following description.

SUMMARY OF THE INVENTION

According to a first aspect of the invention, there is provided a method of mounting a subsea antifouling sign to a structure to be deployed subsea, the method comprising the steps of:

providing a subsea antifouling sign, the sign comprising:

a body of an antifouling material comprising a first surface and a second opposing surface, indicia or markings visible from the first surface; an adhesive layer or coating on the second opposing surface; and a protective lining for the adhesive layer or coating;

removing the protective lining from the adhesive layer or coating; and attaching the subsea antifouling sign to the structure by adhering the adhesive layer or coating to a surface of the structure.

The above-described method simplifies the mounting of the sign compared with the methods known in the art. It reduces the time needed to mount the sign, and does not rely on additional mounting components. The method uses a sign in which the adhesive is applied (and protected) in a controlled manner before the installation of the sign. The method does not rely on application of an adhesive by installation personnel, and therefore problems with inconsistent or inadequate use of adhesives are avoided. Health and safety concerns associated with the handling and use of adhesives are mitigated or avoided by the application of the adhesive in an earlier manufacturing step.

The method provides mounting which is likely to be more consistent (and therefore more reliable), and may also be more resistant to forces acting to detach the mounted subsea antifouling sign from the subsea structure or equipment than the signs mounted using methods known in the prior art.

The subsea antifouling sign may comprise a backing layer, which may be moulded with the antifouling material or may be bonded to the antifouling material. The backing layer may be water impermeable. Alternatively, the backing layer may be water permeable. The backing layer may be a polyethyleneterephthalate (PET) backing layer. Alternatively the backing layer may be solid plastic, steel, rubber or a multipart backing layer. The backing layer (if present) may provide a suitable interface for the antifouling material of the sign and the adhesive layer or coating. Suitable backing layers for the sign include nylon, high density polyethylene (HDPE), a hook and loop fastener material such as VELCRO™, or other plastic or fabric layers capable of withstanding the harsh environments found in subsea locations.

Preferably, the subsea antifouling sign is made of a silicone-based polymeric antifouling material. Preferably the subsea antifouling sign is manufactured by a moulding method. Alternatively the subsea antifouling may be produced by an extrusion or a calendering process.

Preferably the adhesive layer or coating is a part of a double-sided adhesive sheet or tape. The adhesive layer or coating may comprise an acrylic adhesive layer. For example, the adhesive layer may be one commercially available from Champion Environmental Technologies under product designation KISS™. Alternatively or in addition the adhesive layer may comprise a silicone adhesive, a polyurethane adhesive, or an epoxy material.

The adhesive layer or coating may be selected to be compatible with the antifouling material of the sign or the backing layer of the sign to forming a chemical bond with the antifouling material.

In the case of acrylic adhesive layers, over extended periods of time, additional polymer crosslinking is favoured over scission. This implies that, rather than being degraded, the acrylic material may increase its mechanical strength slightly over extended periods of time. This means that a stronger, long lasting attachment may be produced. KISS™ acrylic adhesive layers exhibit a good fatigue resistance because of their viscoelasticity. The acrylic material absorbs energy and redistributes stresses internally, thus helping protect the adhesive attachment on the subsea structure and on the subsea antifouling sign.

When acrylic adhesive layers are used, it may be possible to correct errors committed during the mounting of the subsea antifouling sign. Acrylic adhesive layers are slow curing and permit to remove the subsea antifouling sign after it has been attached to the subsea structure, in order to modify its position or to replace it by another sign, without damaging the subsea structure.

When acrylic adhesive layers are used, a reduced amount of adhesive may be needed compared to mounting methods of subsea antifouling signs described in the prior art.

Additionally, when acrylic adhesive layers are used, the adhesive bonds thereby achieved exhibit an intermediate flexibility between adhesive bonds based on polyurethane adhesives, which are too rigid, and adhesive bonds based on silicone adhesives, which are too flexible. This is due to the viscoelastic nature of the acrylic adhesive bonds.

Preferably the protective lining comprises fluoro-silicone coated paper, although other suitable protective linings may be used.

Preferably the sign has a portion of the adhesive layer or coating close to every edge of its lower surface. Every portion of the adhesive layer or coating may have an edge substantially parallel to an edge of the back side of the lower surface of the sign. The adhesive layer or coating (which may be a part of a sheet or tape) may be provided in a plurality of discrete portions.

By having portions of adhesive layer close to the edges and/or substantially parallel to the edges of the sign, the resistance of the mounted sign to forces acting to detach it from the subsea structure or equipment may be increased.

Removing the protective lining of the adhesive layer may be carried out immediately before attaching the sign to the structure.

The method may comprise preparing a surface of the structure before mounting the subsea antifouling sign. This may comprise applying a primer on the subsea structure. Alternatively or additionally, it may comprise applying a cleaning product to the subsea structure. Alternatively or additionally, it may comprise applying surface treatment to the subsea structure to promote roughness on its surface in order to improve the adhesion of the subsea antifouling sign on the subsea structure.

The subsea antifouling sign may be attached to the subsea structure or equipment by application of pressure to the sign. For example, in embodiments of the invention, a force may be exerted on the subsea antifouling sign using a roller, press, clamp or the like.

The application of pressure to the sign improves the adhesion of the adhesive layer to the subsea structure.

Alternatively or in addition, the method may comprise applying heat to the subsea antifouling sign or to the subsea structure or equipment following the attachment of the subsea antifouling sign on the subsea structure or equipment, which may facilitate curing of the adhesive layer.

Preferably a gap between the perimeter of the subsea antifouling sign and the subsea structure or equipment surface is sealed with a bead of adhesive material. Preferably the adhesive material is water impermeable. Suitable adhesive materials for sealing a gap between the perimeter of the subsea antifouling sign and the subsea structure or equipment surface include acrylic cement, polyurethane (PU) materials, epoxy materials and/or RTV silicones.

A bead of adhesive material sealing a gap between the perimeter of the subsea antifouling sign and the subsea structure or equipment provides protection to the antifouling sign edge, making it more resistant to tearing by marine currents or water jets during routine cleaning. The bead of adhesive material may create a chamfered edge, in contrast with the right angle edge of the subsea antifouling sign, which softens the profile of the sign/material making it less likely to be caught or snagged.

By applying a bead of adhesive material for sealing a gap between the perimeter of the subsea antifouling sign and the subsea structure or equipment, the adhesive bond between the subsea structure and the subsea antifouling sign may be approximately 30% (or more) stronger than in a case when the bead of adhesive material is omitted.

By sealing a gap between the perimeter of the subsea antifouling sign and the subsea structure or equipment surface with a bead of water impermeable adhesive material, the adhesive layer may be completely or partially isolated from water, thus preventing or retarding the deterioration of its adhesive properties. Additionally stagnation of salty water between the subsea antifouling sign and the subsea structure or equipment's surface near the adhesive layer may be reduced, thus reducing the corrosion rate of the subsea structure or equipment next to the adhesive layer.

Additionally, by sealing a gap between the perimeter of the subsea antifouling sign and the subsea structure or equipment surface with a bead of adhesive material, it is possible to use adhesive materials which would not otherwise be expected to maintain a bond for the typical working lifetime specifications required for a subsea antifouling sign. Oilfield projects for example are typically specified to have 20 to 50 year service lives. In contrast, the service life of an acrylic adhesive layer is typically 10 years. However, with embodiments of the invention which seal the perimeter of the sign, it is possible to attach a subsea antifouling sign to a subsea structure and obtain a significantly prolonged lifespan. Performance tests have revealed that the service life of a sign mounted according to this embodiment of the invention can be at least six times longer than that of a conventionally mounted sign (typically 10 years) in the same conditions. In particular, the lifespan may be prolonged over the full service life of a subsea structure (i.e. typically from 20 to 50 years).

According to a second aspect of the invention, there is provided a subsea antifouling sign, comprising:

a body of an antifouling material comprising a first surface and a second opposing surface, indicia or markings visible from the first surface; an adhesive layer or coating on the second opposing surface; and a protective lining for the adhesive layer or coating.

The subsea antifouling sign may comprise a backing layer. The backing layer may be water impermeable. Alternatively, the backing layer may be water permeable. Preferably the backing layer is a polyethylenterephthalate (PET) backing layer. Alternatively the backing layer may be solid plastic, steel, rubber or may be a multipart or composite backing layer.

Preferably, the subsea antifouling sign is made of a silicone-based polymeric antifouling material. Preferably the subsea antifouling sign is manufactured by a moulding method. Alternatively the subsea antifouling may be produced by an extrusion or a calendering process. Preferably the adhesive layer or coating comprises a double-sided adhesive sheet or tape. The adhesive layer or coating may comprise an acrylic adhesive layer. For example, the adhesive layer may be one commercially available from Champion Environmental Technologies under product designation KISS™. Alternatively or in addition the adhesive layer may comprise a silicone adhesive, a polyurethane adhesive, or an epoxy material.

The adhesive layer or coating may be selected to be compatible with the antifouling material of the sign or the backing layer of the sign to forming a chemical bond with the antifouling material.

Preferably the double-sided adhesive sheet or tape has two adhesive layers which are applied to an intermediate carrier layer. In this embodiment the carrier layer adds rigidity to the double-sided adhesive sheet or tape, and improves ease of handling and application.

In embodiments of the invention the adhesive layer may comprise a double-sided adhesive sheet or tape comprising a carrier layer and two adhesive layers of different composition. Each adhesive layer may be formulated to maximise the adhesion between the adhesive layer and the surface to which the tape is to be adhered. For example, an adhesive layer which is a double-sided adhesive tape wherein one side of the adhesive tape is formulated to adhere to a plastic substrate and the other side of the adhesive tape is formulated to adhere to a metal substrate.

Preferably the protective lining comprises fluoro-silicone coated paper.

Embodiments of the second aspect of the invention may include one or more features of the first aspect of the invention or its embodiments, or vice versa.

According to a third aspect of the invention, there is provided a subsea structure comprising a subsea antifouling sign mounted on a surface thereof, wherein the subsea antifouling sign is attached to the surface of the subsea structure or equipment by the method of the first aspect of the invention.

Embodiments of the third aspect of the invention may include one or more features of the first or second aspect of the invention or its embodiments, or vice versa.

According to a fourth aspect of the invention, there is provided a subsea structure comprising a subsea antifouling sign mounted on a surface thereof, wherein the subsea antifouling sign is according to the second aspect of the invention.

Embodiments of the fourth aspect of the invention may include one or more features of the first to third aspects of the invention or its embodiments, or vice versa.

According to a fifth aspect of the invention, there is provided a method of forming a subsea antifouling sign, the method comprising:

forming a body of an antifouling material comprising a first surface and a second opposing surface, and indicia or markings visible from the first surface;

disposing an adhesive layer or coating on the second opposing surface; and disposing a protective lining over the adhesive layer or coating.

Embodiments of the fifth aspect of the invention may include one or more features of the first to fourth aspects of the invention or its embodiments, or vice versa.

According to a sixth aspect of the invention, there is provided a method of forming a subsea antifouling sign, the method comprising:

forming a body of an antifouling material comprising a first surface and a second opposing surface, and indicia or markings visible from the first surface;

disposing a double-sided adhesive sheet or tape on the second opposing surface comprising an adhesive layer or coating and a protective lining.

Embodiments of the sixth aspect of the invention may include one or more features of the first to fifth aspects of the invention or its embodiments, or vice versa.

BRIEF DESCRIPTION OF THE DRAWINGS

There will now be described, by way of example only, various embodiments of the invention with reference to the drawings, of which.

DETAILED DESCRIPTION OF PREFERRED EMBODIMENTS

Figure 1:
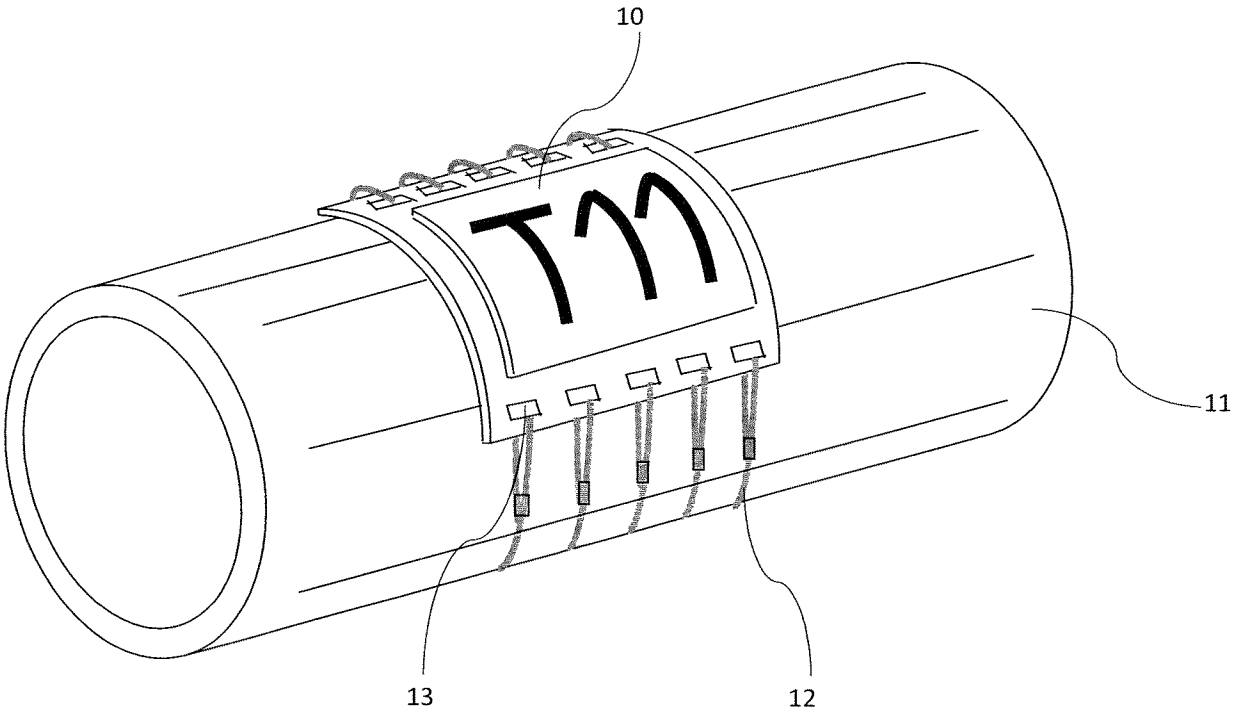
Figure 1 (Prior Art)
FIG. 1 is a representation of a subsea antifouling sign mounted on a subsea structure by a method according to the prior art.

As described above, FIG. 1 shows features of a subsea antifouling sign mounted on a subsea structure according to a method known in the prior art.

Figure 2A:
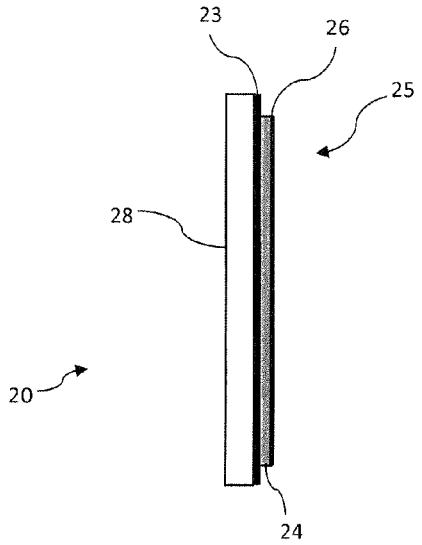
FIGS. 2A and 2B are respectively side and plan views of a sign according to a first embodiment of the invention.
Figure 2B:
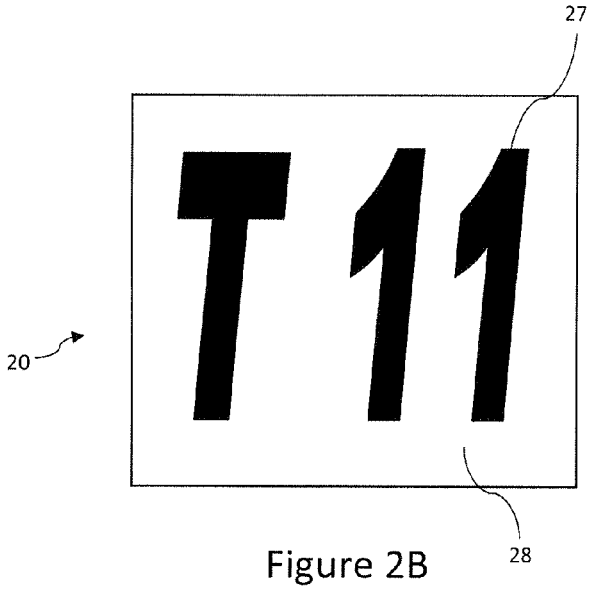

FIGS. 2A and 2B show an anti-fouling sign 20 according to a first embodiment of the invention, shown from a side elevation and a plan view respectively. The sign 20 is moulded from a silicone-based antifouling material, according to methods known in the art. The sign 20 comprises a polyethyleneterephthalate (PET) backing layer 23, joined to the silicone material across the rear surface 25 of the sign 20. The PET backing layer is located inside the mould before adding the silicone-based antifouling material. The silicone based antifouling material is added to the mould and is allowed to cure after which the PET backing layer is firmly attached to the silicone-based antifouling material. Subsequently, an adhesive acrylic layer 24 is uniformly spread on the PET backing layer 23 and a fluoro-silicone coated paper lining 26 is applied on top of the acrylic adhesive layer in order to prevent the adhesive acrylic layer 24 from losing its adhesive properties during storage and ensure that the sign is easy to manipulate and handle.

The resulting sign 20 is a planar moulded body bearing integrated silicone alphanumeric characters 27 which are visible from its front surface 28. The sign has good anti-fouling properties suitable for subsea use over a long working lifetime. The sign has a pre-formed adhesive layer which can be used to install the sign on an item of marine or subsea equipment as described below.

Figure 3A:
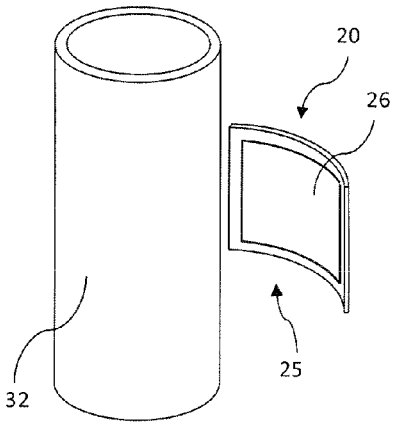
FIGS. 3A, 3B, and 3C show schematically a method of mounting a subsea antifouling sign to a subsea structure according to an embodiment of the invention.
Figure 3B:
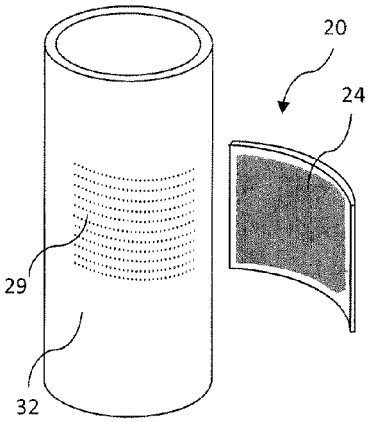
Figure 3C:
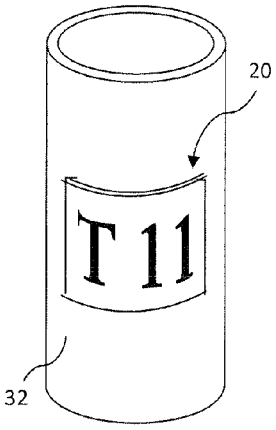

FIGS. 3A, 3B, and 3C show schematically steps of a method of mounting the subsea antifouling sign 20 on a subsea structure 32 according to an embodiment of the invention. The subsea sign 20, as shown in FIG. 3A, comprises a PET backing layer 23 and an adhesive acrylic layer 24 on its rear surface 25, which initially has the protective lining 26 in place. The subsea structure 32 is a pipe section made of steel, shown here at surface before deployment subsea. As shown in FIG. 3B, the surface 29 of the subsea structure 32 in the area to which the sign is to be applied has been prepared by the application of a primer to improve adhesion. The fluoro-silicone coated paper 26 is removed from the acrylic adhesive layer 24, and the sign 20 is ready to be adhered to a surface 29 of the subsea structure 32. As shown in FIG. 3C the sign is adhered to the pipe 32 by contact of the acrylic adhesive layer with the pipe to form a bond.

By providing a sign with an adhesive layer and a protective film, the invention facilitates convenient attachment of a subsea antifouling sign to an item of subsea equipment. The method does not require additional equipment or fixings and does not rely on application of an adhesive layer by the installation operator. An advantage of this method is that as soon as the sign and its material are placed on the tubular it is held in place sufficiently so that it does not peel back. This avoids the use of banding or other securing means during the installation method.

Figures 4A, 4B, 4C:
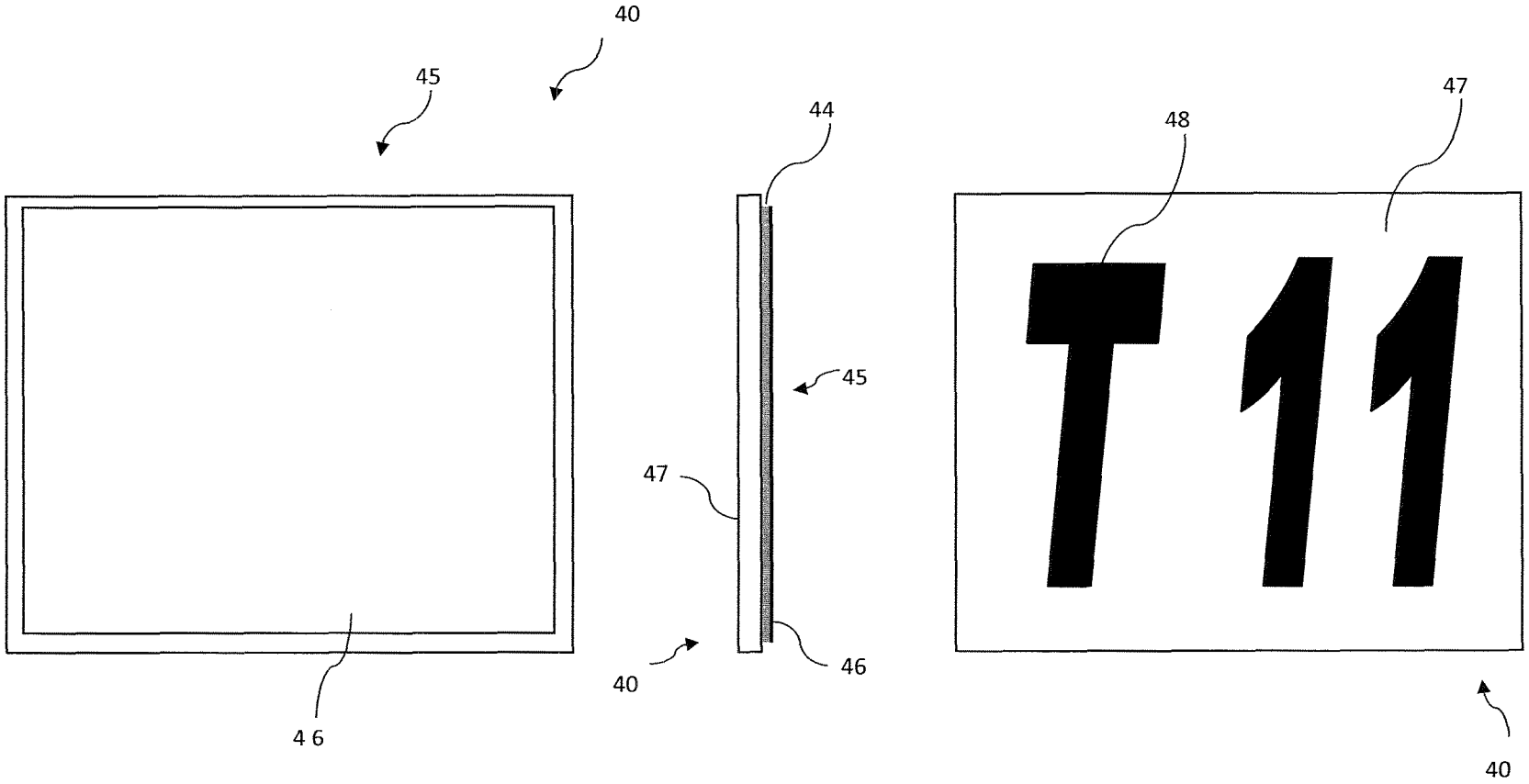
FIGS. 4A, 4B and 4C show a sign according to an alternative embodiment of the invention, in lower, side, and plan views respectively.

FIGS. 4A, 4B and 4C show a sign 40 according to an alternative embodiment of the invention, in lower, side, and plan views respectively. The sign 40 is similar to the sign 20, and will be understood from FIGS. 2A and 2B and the accompanying text. The sign is a silicone-based antifouling sign formed by moulding alphanumeric characters 48 into a planar layer to be visible from an upper surface 47. A lower surface 45 of the sign is provided with a layer 44 of a double-sided adhesive sheet. A protective film of fluoro-silicone coated paper 46 is placed over the lower side of the adhesive sheet to prevent the adhesive acrylic layer 44 from losing its adhesive properties during storage and ensure that the sign is easy to manipulate and handle. The upper side of the adhesive sheet 44 is bonded to the silicone material of the sign 40. In this embodiment, the sign 40 does not include a backing layer between the silicone material and the adhesive sheet, although in an alternative embodiment a backing layer may be used to improve the adhesion between the sheet 44 and the silicone material.

Figure 5A:
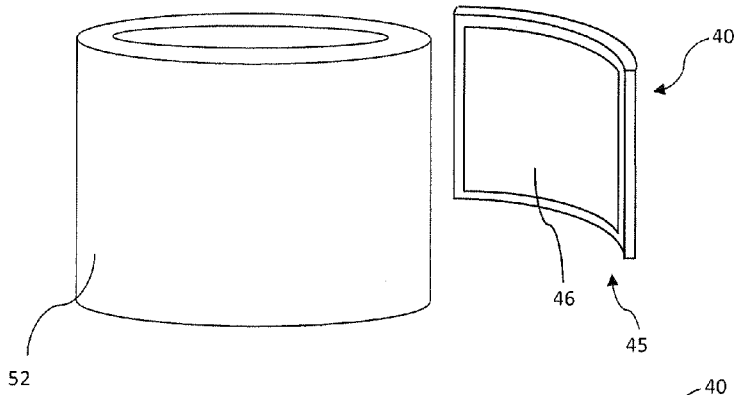
FIGS. 5A, 5B, 5C and 5D show schematically steps of a method of mounting a subsea antifouling sign on a subsea structure according to an embodiment of the invention.
Figure 5B:
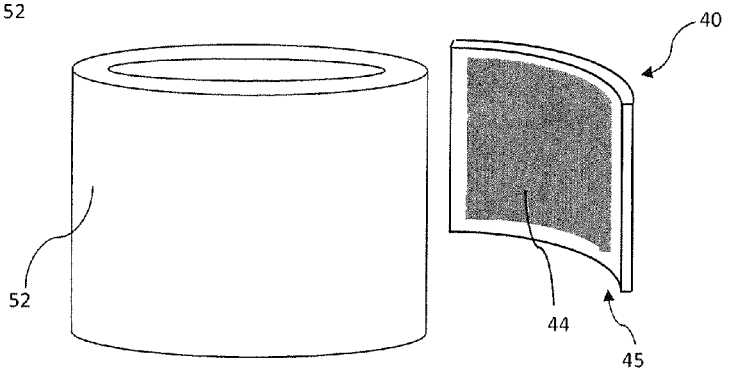
Figure 5C:
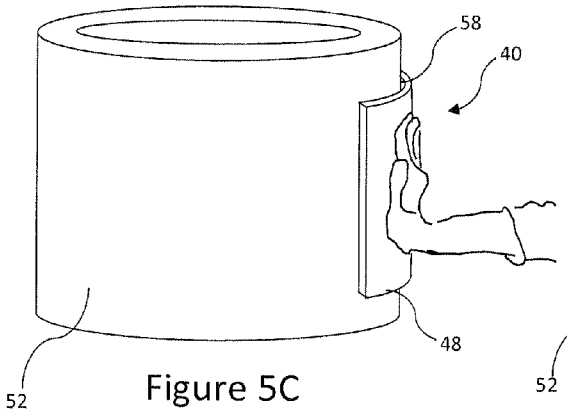

FIGS. 5A, 5B, 5C and 5D show schematically steps of a method of mounting the subsea antifouling sign 40 on a subsea structure 52 according to an embodiment of the invention. The subsea sign 40, as shown in FIG. 3A, comprises the adhesive sheet 44 on its rear surface 45, which initially has the protective lining 46 in place. The subsea structure 52 is also a pipe section made of steel, shown here at surface before deployment subsea. In this embodiment, it is not necessary to prepare the surface of the subsea structure 52 in the area to which the sign is to be applied. The fluoro-silicone coated paper 46 is removed from the adhesive sheet 44 to expose the lower adhesive, and the sign 40 is ready to be adhered to a surface of the subsea structure 52. As shown in FIG. 5C the sign is adhered to the pipe 52 by contact of the acrylic adhesive layer with the pipe to form a bond. Pressure is applied to the sign 40, in this case by pressing the subsea antifouling sign against the subsea structure manually. Other suitable methods of pressing the subsea antifouling sign against the subsea structure include using a clamp, a roller, or a press.

Figure 5D:
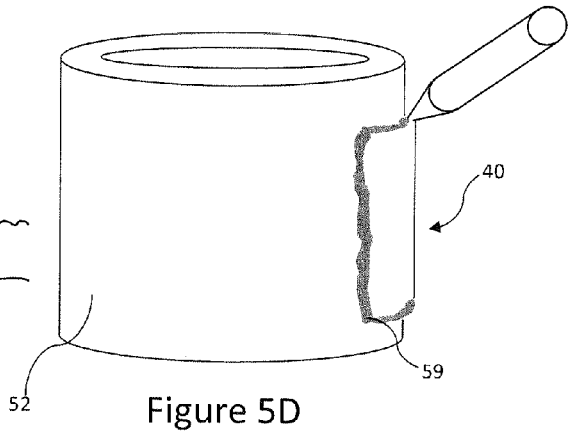

In a subsequent step, shown in FIG. 5D, the interface between the sign 40 and the subsea structure 52 is sealed by application of a bead 59 of adhesive around the perimeter of the sign 40. In this case, the adhesive is a silicone adhesive but other suitable adhesives may be used in alternative embodiments.

In this embodiment, the sign is supplied to the installation operator with an adhesive layer located over substantially the whole lower surface of the sign, and close to the edges of the sign to provide a secure bond to the subsea equipment. Sealing the perimeter of the sign further improves the strength of the attachment, and reduces the tendency for the sign to peel from its edges. The seal also resists water ingress and provides protection against forces from cleaning operations or other subsea activity which may tend to damage the sign at its edges.

Figure 6C:
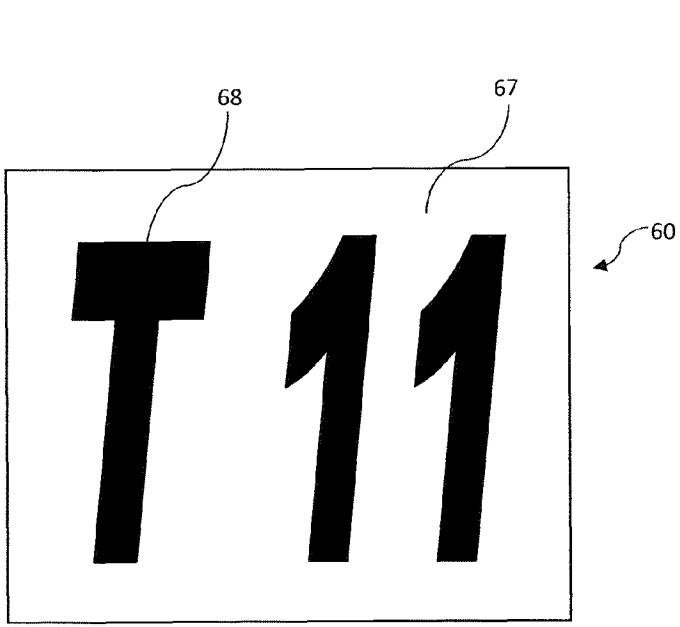
FIGS. 6A, 6B, and 6C show a sign according to an alternative embodiment of the invention, in lower, side, and plan views respectively.
Figure 6B:
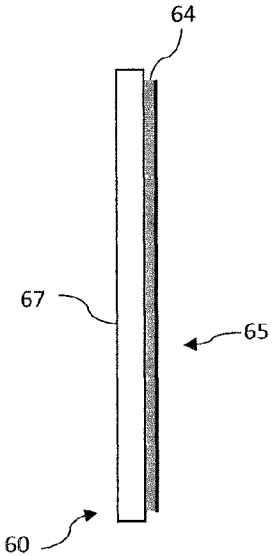
Figure 6A:
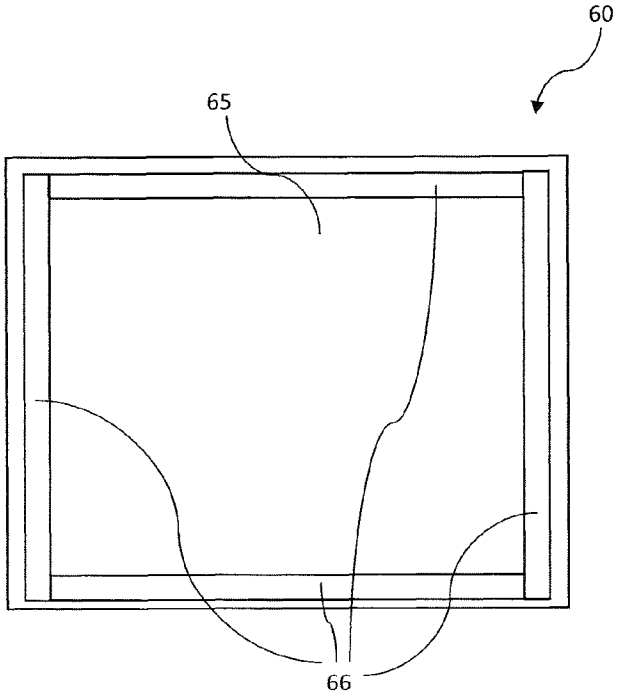

FIGS. 6A, 6B, and 6C show a sign 60 according to an alternative embodiment of the invention, in lower, side, and plan views respectively. The sign 60 is similar to the sign 40, and will be understood from FIG. 4 and the accompanying text. However, on the sign 60, the adhesive sheet is not provided over substantially the whole lower surface 65, and instead comprises four discrete portions of a double-sided adhesive tape 66 located adjacent the perimeter of the sign 60. Application of the sign 60 to a structure will be understood from the preceding embodiments. Other arrangements of adhesive sheet or adhesive tape may be used within the scope of the invention.

EXAMPLES

Standard and aggressive immersion tests carried out on samples representative of this embodiment show their superior performance versus other methods of mounting an antifouling sign.

Figure 7A:
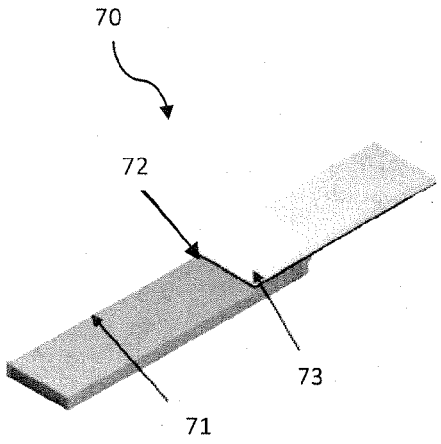
FIG. 7A shows schematically a sample suitable for carrying out a lap-shear adhesive test.
Figure 7B:
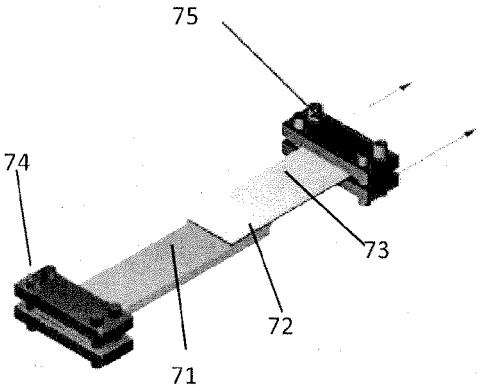
FIG. 7B shows schematically an apparatus on which a lap-shear adhesive test is being carried out.

FIGS. 7A and 7B respectively show a sample and an experimental set-up for the performance of lap-shear adhesive tests. FIG. 7A shows a typical sample 70 representative of an adhesive bond between a subsea antifouling sign and an epoxy coated steel subsea structure suitable for carrying a lap-shear test. The sample 70 consists of a rectangular piece of epoxy coated steel 71 of known dimensions are known, bonded with adhesive 72 to a rectangular piece of subsea antifouling sign 73, such that the overlapping area has known dimensions.

FIG. 7B shows the sample 70 represented in FIG. 7A upon which a lap-shear adhesive test is being carried out as described in standard normative of the American Society of Testing Materials (ASTM) number D3165. The tests were carried out with a Testometric™ M350-5CT twin column tensile testing machine fitted with an LC250 2500N load cell. Scissor grips 74, 75 with a knurled surface were used to clamp the samples. In order to carry out the lap-shear adhesive test, the sample is clamped in the testing machine (not shown) using grips 74, 75. During the lap-shear adhesive test, the movable grip 75 is displaced away from the fixed grip 74 at a constant speed and the force applied to the movable grip is recorded by the testing machine against the displacement of the grip. The maximum or peak force resisted by the sample is then plotted versus the time the sample has spent in the seawater bath. Once the samples have been broken apart, the fractured areas are examined to determine the failure mode.

The peak forces resisted by the samples can be divided by the area of the adhesive bond in order to normalise results and make them more comparable. This parameter is referred to as adhesive strength, having units of Newtons per unit area, in this case Newtons per squared millimeter.

The immersion tests consisted of submerging the samples in synthetic seawater. The temperature of the synthetic seawater bath was 70° C. in the aggressive immersion tests and 50° C. in the standard immersion tests. The lap-shear adhesive tests were carried out using samples that have undergone an immersion test, either aggressive (carried out at 70° C.) or standard (carried out at 50° C.).

After increasing amounts of time (several days or weeks) some samples were removed from the thermostatic seawater bath and a lap-shear adhesive test was carried out Every few days the lap-shear adhesive test was repeated using samples that had remained for the longer time within the seawater bath.

In a first example, the performance of samples representative of the mounting method according to FIGS. 5A to 5D was compared with samples formed according to a conventional mounting method of subsea signs using the two-part polyurethane adhesives of the prior art. The conventional system is acknowledged in the industry to have a 50 year lifespan in a subsea environment.

Aggressive immersion tests revealed that the adhesive bond of samples representing the conventionally mounted subsea sign using polyurethane adhesives failed after approximately 20 days of immersion in the thermostatic seawater bath. In contrast, samples made according to the method of FIGS. 5A to 5D did not show adhesive bond failure during the 28 days of study. By analogy with the real world performance of the conventional polyurethane sign mounting methods, the tests showed that the signs mounted using the method of FIGS. 5A to 5D can be inferred to have a lifespan greater than the lifespan of the comparative example (i.e. greater than the guaranteed 50 years of the conventional mounting and even in excess of 60 years).

In another comparative test, samples representative of signs mounted with the method described in GB 2434022, were subjected to an aggressive immersion test using the experimental set-up described with reference to FIGS. 7A and 7B. As before, a subsequent lap-shear adhesive test was carried out after the samples had been for different lengths of time within the aggressive immersion testing bath. The test results are represented in the graph of FIG. 8, along with the results of the aggressive immersion tests of the samples mounted according to the method depicted in FIG. 5A to 5D of the present invention.

Figure 8:
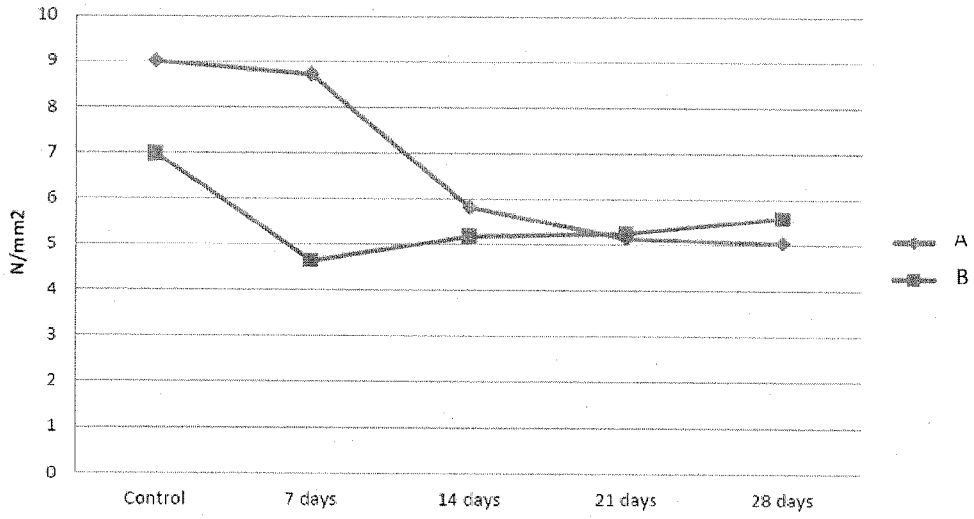
FIG. 8 shows a graph comparing aggressive immersion test results corresponding to the embodiment of FIG. 5D and to a sign mounted using silicone adhesives.

FIG. 8 plots adhesive strength of against immersion time for a conventional bonding method (plot A) and a sign bonded according to the method of FIGS. 5A to 5D (plot B). The results show that the method of mounting subsea antifouling signs according to FIGS. 5A to 5D exhibits a reduced adhesive bond degradation rate over time compared to samples mounted with the prior art method. Additionally, the data corresponding to the sample representative of the present invention (plot B) shows an upward trend in adhesive strength indicating that the adhesive bond will become stronger over prolonged periods of time, whereas the data corresponding to the prior art (plot A) sample shows a downward trend, indicating that the adhesive bond could fail over prolonged periods of time.

It can be concluded that in the case of acrylic adhesive layers, over extended periods of time, additional polymer crosslinking is favoured over scission. This implies that, rather than being degraded, the acrylic material increases its mechanical strength slightly over extended periods of time. This means that a stronger, long lasting attachment is produced. Acrylic adhesive layers exhibit a good fatigue resistance because of their viscoelasticity. The acrylic material absorbs energy and redistributes stresses internally, thus helping protect the adhesive attachment on the subsea structure and on the subsea antifouling sign.

Figure 9:
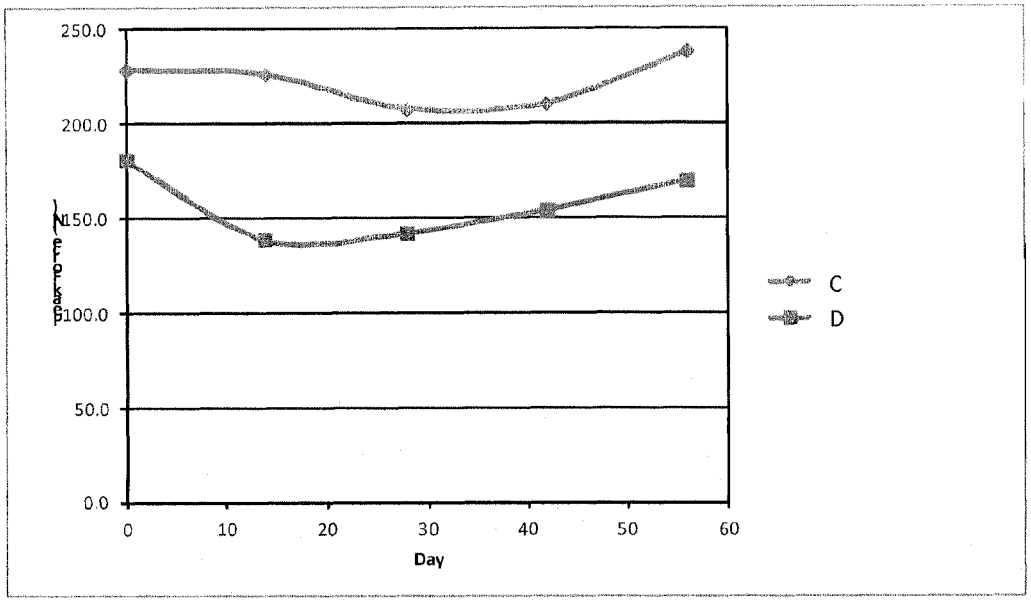
FIG. 9 shows a graph comparing immersion test results corresponding to the embodiment of FIG. 5D and to a sign corresponding to a similar embodiment but without the adhesive bead surrounding the antifouling subsea sign.

In another example, standard immersion tests were carried out at 50° C. according to the methodology of FIG. 7A, on samples prepared according to the method of FIGS. 5A to 5D, and alternative samples where the last step of the method was not carried out, i.e. the step of applying a sealing bead of adhesive was omitted. FIG. 9 plots peak force against immersion time for the two sample sets, with plot C being the data collected for the samples with the adhesive bead applied, and plot D being the data for the samples with no adhesive bead applied. The results of the subsequent lap-shear adhesive tests (described above) show that the bond strength of the samples mounted according to the method represented in FIGS. 5A to 5D (with adhesive bead) are approximately 30% higher than the bond strength of samples mounted similarly but omitting the sealing adhesive bead around the edge of the subsea sign.

This example illustrates the surprising result that a sealing bead which is applied to the edge of the subsea antifouling sign to surround it completely, protects the adhesive bond between the antifouling subsea sign and the subsea infrastructure, retards its degradation and provides additional bond strength compared to a case where the sealing bead is not applied.

The embodiment with a bead of adhesive around it has also passed environmental tests according to standard normative BS-EN-ISO 60068 and a test of 706 bar of pressure.

The invention provides a subsea antifouling sign and a method for mounting such a sign on a structure to be located subsea. The sign comprises a body of an antifouling material, and a first surface of the body has indicia or markings thereon. An adhesive layer or coating is provided on a second opposing surface, and a protective lining is located on the adhesive layer or coating. The method comprises removing the protective lining from the adhesive layer or coating; and attaching the subsea antifouling sign to the structure by adhering the adhesive layer or coating to a surface of the structure.

The process of mounting a subsea antifouling sign is performed before deploying the structure into its definitive subsea location. The method provides a more durable attachment of the subsea sign to the subsea structure and addresses issues of corrosion and other detrimental effects produced at the interface between the subsea sign and the subsea structure. Another benefit of this method is that the attachment between the subsea sign and the subsea structure may withstand higher forces due to marine currents, cleaning operations and impacts by remotely operated vehicles.

The foregoing description of the invention has been presented for the purposes of illustration and description and is not intended to be exhaustive or to limit the invention to the precise form disclosed. The described embodiments were chosen and described in order to best explain the principles of the invention and its practical application to thereby enable others skilled in the art to best utilise the invention in various embodiments and with various modifications as are suited to the particular use contemplated. Therefore, further modifications or improvements may be incorporated without departing from the scope of the invention herein intended.

The invention claimed is:

1. A method of mounting a subsea antifouling sign to a structure or equipment to be deployed subsea, the method comprising the steps of:

providing a subsea antifouling sign, the sign comprising:

a body of an antifouling material comprising a first surface and a second opposing surface, indicia or markings visible from the first surface;

an adhesive layer or coating on the second opposing surface, wherein the adhesive layer or coating comprises a double-sided adhesive sheet or tape; and a protective lining for the adhesive layer or coating;

removing the protective lining from the adhesive layer or coating;

attaching the subsea antifouling sign to the structure by adhering the adhesive layer or coating to a surface of the structure; and sealing a gap between a perimeter of the body of the antifouling material and the subsea structure or equipment surface with a separate bead of adhesive material, wherein the adhesive material is selected from the group consisting of acrylic cement, polyurethane materials, epoxy materials and RTV silicones.

2. The method according to claim 1 wherein the subsea antifouling sign is manufactured by a moulding method.

3. The method according to claim 1 wherein the adhesive layer or coating comprises an acrylic adhesive layer.

4. The method according to claim 1 wherein the protective lining comprises fluoro-silicone coated paper.

5. The method according to claim 1 comprising preparing a surface of the structure before mounting the subsea antifouling sign.

6. The method according to claim 1 wherein the adhesive material is water impermeable.

7. A subsea structure comprising a subsea antifouling sign mounted on a surface thereof, wherein the subsea antifouling sign comprises a body of an antifouling material having a first surface and a second opposing surface, wherein indicia or markings are visible from the first surface; and an adhesive layer or coating on the second opposing surface, wherein the adhesive layer or coating comprises a double-sided adhesive sheet or tape;

wherein the subsea antifouling sign is attached to the surface of the subsea structure by removing a protective lining from the adhesive layer or coating and adhering the adhesive layer or coating to a surface of the structure; and wherein the structure further comprises a separate bead of adhesive material selected from the group consisting of acrylic cement, polyurethane materials, epoxy materials and RTV silicones, which seals a gap between a perimeter of the body of the antifouling material and the subsea structure surface.

8. The subsea structure according to claim 7 wherein the subsea sign comprises a backing layer.

9. The subsea structure according to claim 7 wherein the subsea sign comprises a silicone-based polymeric antifouling material.

10. The subsea structure according to claim 7 wherein the subsea sign is manufactured by a moulding method.

11. The subsea structure according to claim 7 wherein the adhesive layer or coating of the subsea sign comprises an acrylic adhesive layer.

12. The subsea structure according to claim 7 wherein the double-sided adhesive sheet or tape has two adhesive layers which are applied to an intermediate carrier layer.

13. The subsea structure according to claim 12 wherein the double-sided adhesive sheet or tape comprises a carrier layer and two adhesive layers of different composition.

14. The subsea structure according to claim 7 wherein the protective lining for the adhesive layer of subsea sign comprises fluoro-silicone coated paper.

15. The subsea structure according to claim 7 wherein the adhesive layer or coating of the subsea sign comprises a plurality of discrete portions.

* * * * *